US007581968B1

(12) United States Patent
Gao et al.

(10) Patent No.: US 7,581,968 B1
(45) Date of Patent: Sep. 1, 2009

(54) RECEPTACLE CONNECTOR

(75) Inventors: Ni Gao, Tu-Cheng (TW); Wei-Hong Liao, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/149,284

(22) Filed: Apr. 30, 2008

(51) Int. Cl.
*H01R 13/44* (2006.01)

(52) U.S. Cl. ..... 439/135; 439/521; 439/136; 220/241

(58) Field of Classification Search ..... 439/521, 439/135, 136, 148; 220/241
See application file for complete search history.

(56) References Cited

U.S. PATENT DOCUMENTS 6,183,274 B1 * 2/2001 Allum ..... 439/135
6,309,247 B1 * 10/2001 Wang ..... 439/521
6,927,341 B1 * 8/2005 Crane ..... 174/66
D589,886 S * 4/2009 Gao et al. ..... D13/147

* cited by examiner

*Primary Examiner*—Tho D Ta
(74) *Attorney, Agent, or Firm*—Rosenberg, Klein & Lee

(57) ABSTRACT

A receptacle connector is adapted to mate with a plug connector having at least one latch. The receptacle connector includes a connector body, a plurality of terminals received in the connector body and at least one dust-proof cover. The connector body defines at least one perforation therethrough. The perforation has a first port from which the latch of the plug connector is received in the perforation, and a second port communicating with the first port. The dust-proof cover is mounted on a rear portion of the connector body to seal the second port of the perforation to prevent dust outside the perforation from entering along the perforation.

4 Claims, 5 Drawing Sheets

RECEPTACLE CONNECTOR

BACKGROUND OF THE INVENTION

1. Field of the Invention

The present invention generally relates to an electric connector, and more particularly to a receptacle connector.

2. The Related Art

Referring to FIG. 1 and FIG. 2, traditionally, a receptacle connector 5 is adapted to electrically mate with a plug connector 6. The receptacle connector 5 has two perforations 51 defined at two sides thereof and longitudinally therethrough. The receptacle connector 5 further includes a plurality of terminals 50 received in a middle thereof and passing through a front thereof. The plug connector 6 includes two latches 61 longitudinally configured at two sides thereof and stretching out from a front thereof. The plug connector 6 further includes a plurality of plug terminals 60 received in a middle thereof and protruding out from the front thereof. When the plug connector 6 is inserted in the receptacle, connector 5, the latches 61 are inserted in the respective perforations 51 to make the plug terminals 60 electrically contact with the corresponding terminals 50 firmly. However, the perforation 51 of the receptacle connector 5 freely opens from front to rear so that dust outside the perforation 51 is apt to enter an electronic device (such as a mobile phone) connected with the receptacle connector 5 along the perforation 51 to contaminate a printed circuit board of the electronic device.

SUMMARY OF THE INVENTION

An object of the present invention is to provide a receptacle connector adapted to mate with a plug connector having at least one latch. The receptacle connector includes a connector body, a plurality of terminals received in the connector body and at least one dust-proof cover. The connector body defines at least one perforation therethrough. The perforation has a first port from which the latch of the plug connector is received in the perforation, and a second port communicating with the first port. The dust-proof cover is mounted on a rear portion of the connector body to seal the second port of the perforation.

As described above, the dust-proof cover is mounted on the rear portion of the connector body so as to seal the second port of the perforation for preventing dust outside the perforation from entering an electronic device along the perforation to contaminate a printed circuit board of the electronic device.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
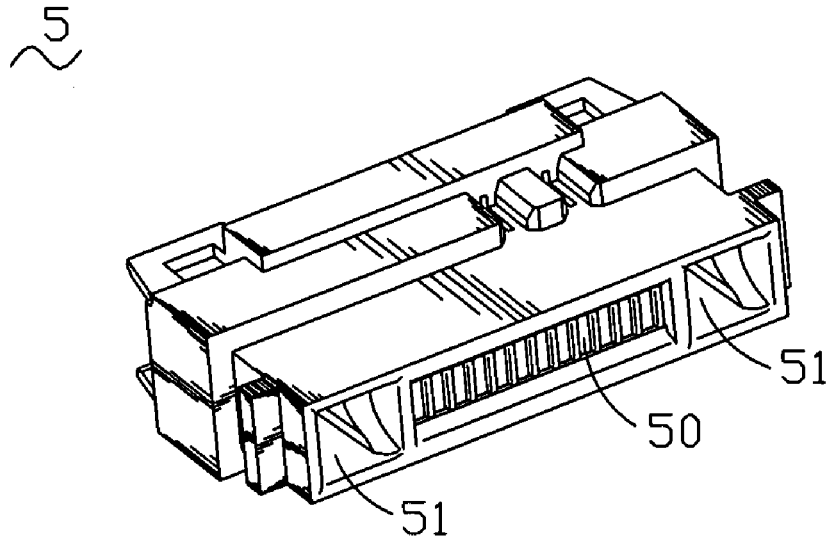
FIG. 1 (Prior Art)
FIG. 1 is a perspective view of a traditional receptacle connector.
Figure 2:
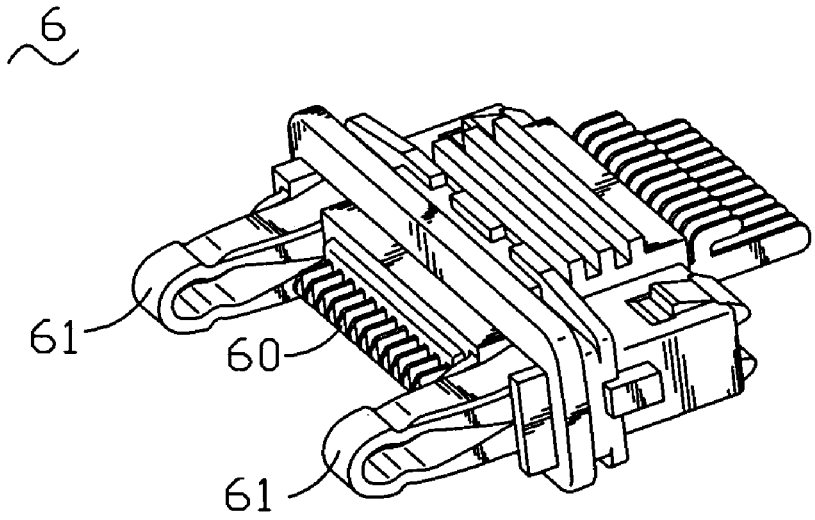
FIG. 2 (Prior Art)
FIG. 2 is a perspective view of a prior plug connector, which is adapted to electrically mate with the traditional receptacle connector of FIG. 1.
Figure 3:
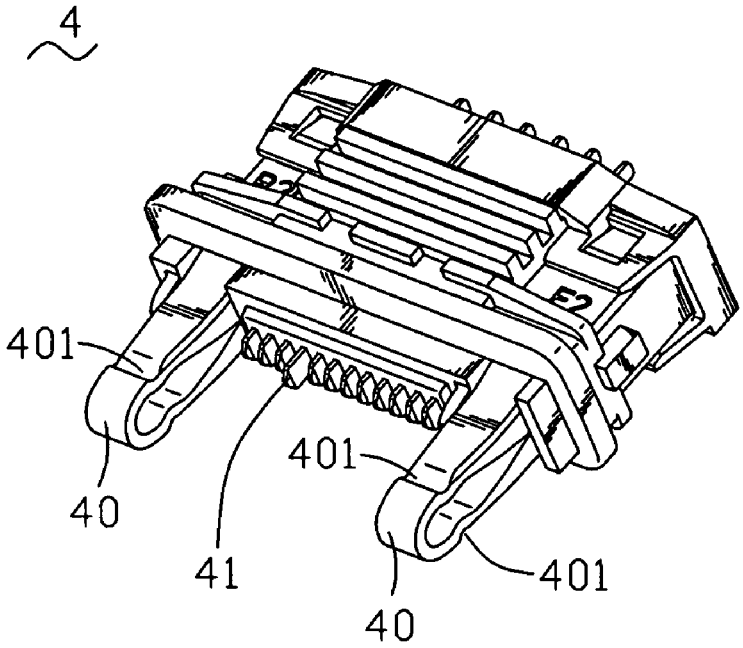
FIG. 3 is a perspective view of a plug connector, which is adapted to electrically mate with a receptacle connector in accordance with the present invention.
Figure 4:
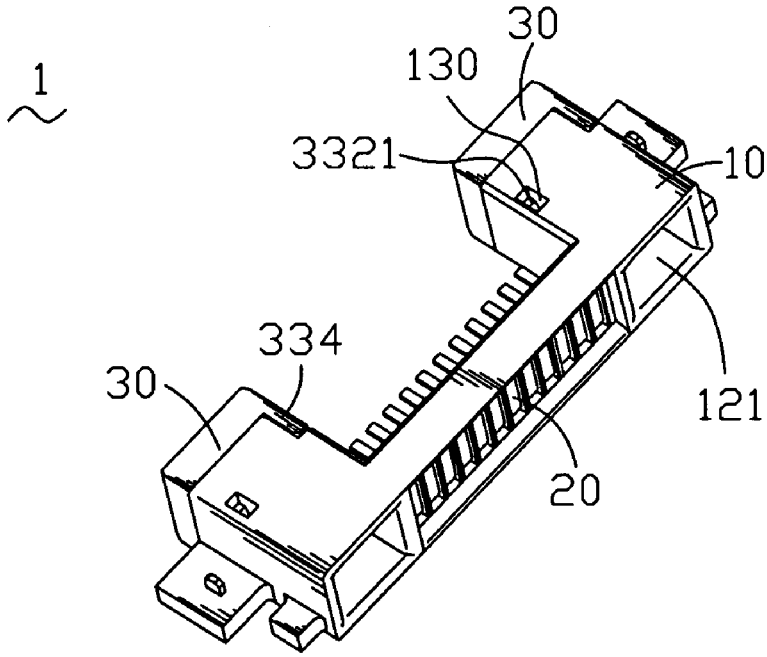
FIG. 4 is a perspective view of the receptacle connector in accordance with the present invention.
Figure 5:
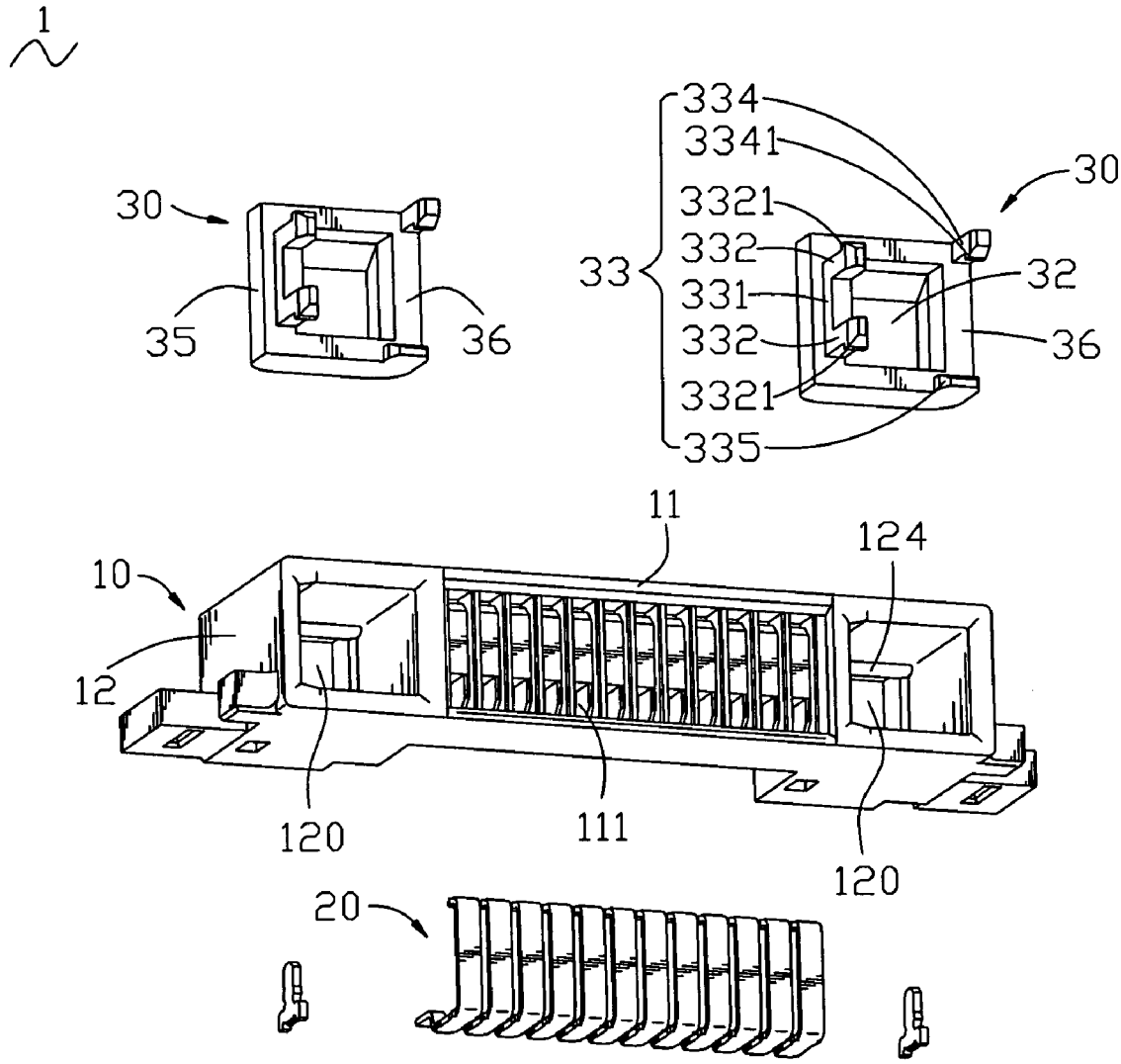
FIG. 5 is an exploded view of the receptacle connector of FIG. 4.

With reference to FIGS. 3-5, a receptacle connector 1 is adapted to electrically mate with a plug connector 4. The plug connector 4 includes two latches 40 configured at two sides thereof and stretching out from a front of the plug connector 4. A front of the latch 40 transversely defines two fillisters 401 respectively at a top and a bottom thereof. The plug connector 4 further includes a plurality of plug terminals 41 received in the plug connector 4 and located between the two latches 40 to stretch out from the front of the plug connector 4. The receptacle connector 1 includes a connector body 10, a plurality of terminals 20 received in the connector body 10 and two dust-proof covers 30.

Figure 6:
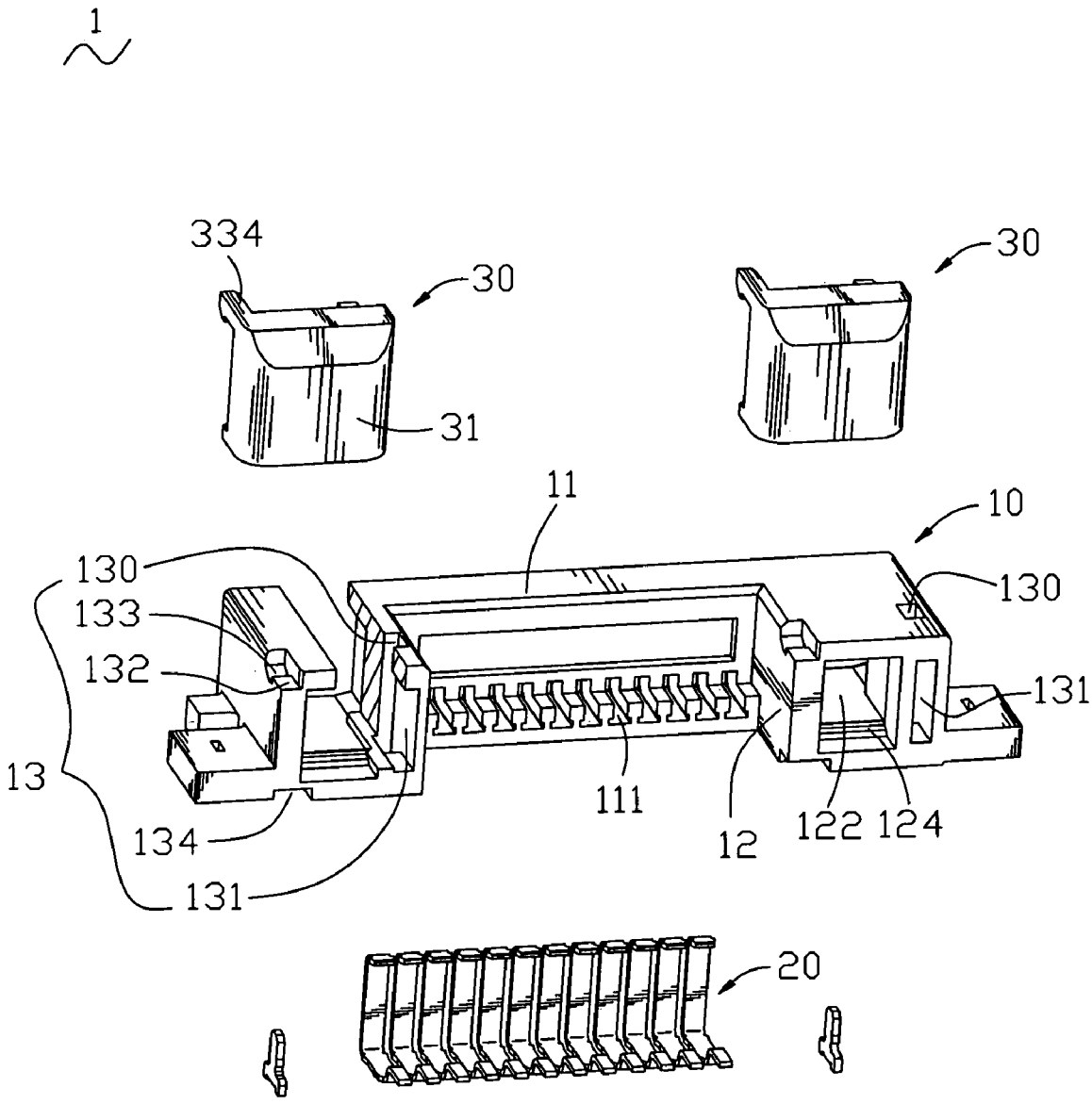
FIG. 6 is another angle exploded view of the receptacle connector of FIG. 4, wherein a connector body is partially cut open.
Figure 7:
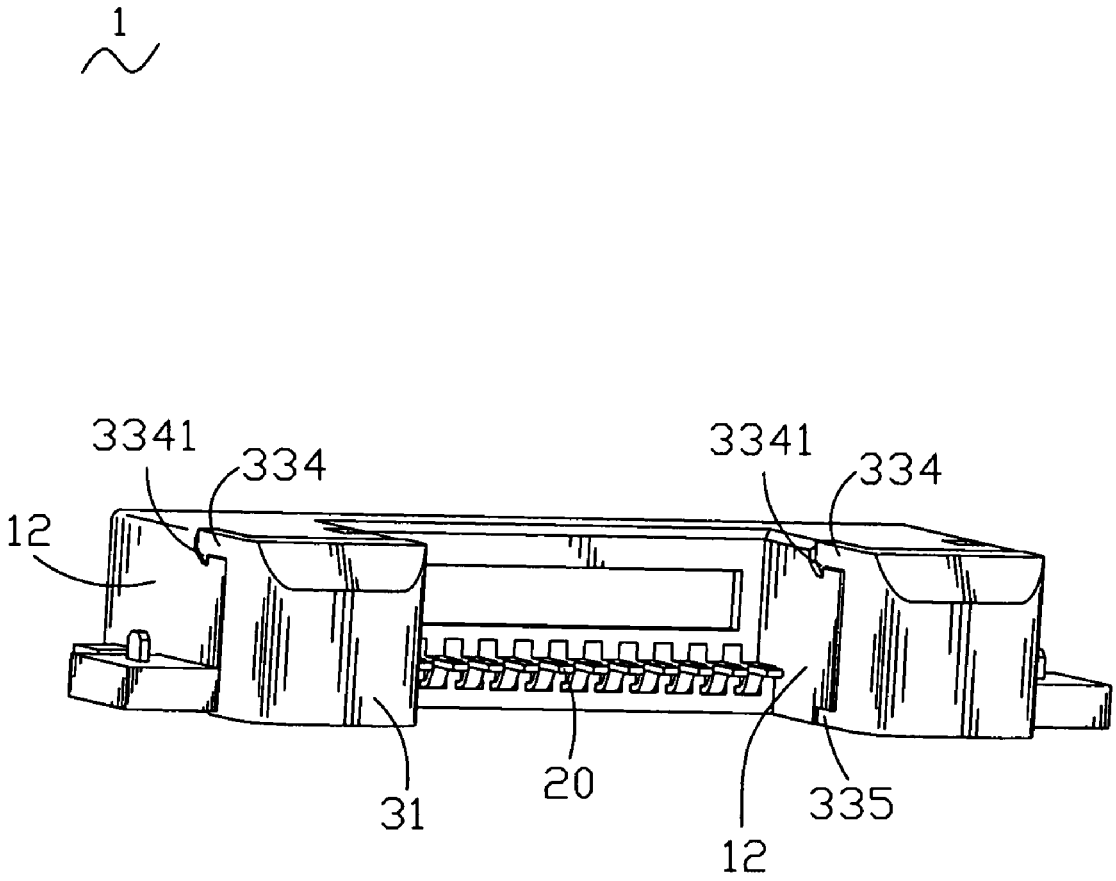
FIG. 7 is another angle perspective view of the receptacle connector of FIG. 4.

Referring to FIG. 5 and FIG. 6, the connector body 10 has a front wall 11 and two sidewalls 12. The front wall 11 connects a front of the two sidewalls 12 and defines a plurality of cavities 111 arranged at regular intervals along a longwise direction thereof for receiving the corresponding terminals 20. Each of the sidewalls 12 defines a rectangular perforation 120 longitudinally therethrough. The perforation 120 has a first port 121 at front from which the corresponding latch 40 of the plug connector 4 is received in the perforation 120, and a second port 122 at rear communicating with the first port 121. A top and a bottom of the second port 122 respectively protrude into the second port 122 to form a pair of fixing ribs 124 extending transversely and facing each other. A rear of the sidewall 12 concaves forward to form a rectangular groove 131 adjacent to a left side of the perforation 120. A front of the groove 131 extends upward and downward respectively to penetrate the sidewall 12 for defining a pair of fixing holes 130. A rear of a top of the sidewall 12 concaves forward to form a gap 132 located at a right side of the perforation 120. A front of the gap 132 extends downward to form a fixing trough 133. A rear of a bottom of the sidewall 12 concaves forward to form a fixing recess 134 located at the same side with the gap 132. The groove 131, the fixing holes 130, the gap 132, the fixing trough 133 and the fixing recess 134 define a fixing section 13.

Each of the dust-proof covers 30 has a rectangular base body 31 located vertically. A middle of a front of the base body 31 concaves rearward to form a rectangular receiving space 32. Accordingly, the receiving space 32 defines a left sidewall 35 and a right sidewall 36 facing each other. A middle of the left sidewall 35 protrudes forward to form a fixing block 331 extending vertically in accordance with the corresponding groove 131 of the connector body 10. A top and a bottom of the fixing block 331 respectively extend forward to form a pair of fixing arms 332. A front of one of the fixing arms 332 protrudes upward and a front of the other fixing arm 332 protrudes downward to form a pair of hooks 3321 opposite to each other. A top of the right sidewall 36 extends forward to form a fixing bar 334 according to the respective gap 132 of the connector body 10. A front of the fixing bar 334 protrudes downward to form a barb 3341. A bottom of the right sidewall 36 protrudes forward to form a protrusion 335 in accordance with the corresponding fixing recess 134 of the connector body 10. The fixing block 331, the fixing arms 332, the hooks 3321, the fixing bar 334, the barb 3341 and the protrusion 335 define a locking portion 33.

Referring to FIGS. 3-7, in assembly, the terminals 20 are received in the respective cavities 111 of the connector body 10. The dust-proof covers 30 are respectively mounted on the rear of the corresponding sidewalls 12 of the connector body 10 and the receiving space 32 communicates with the corresponding second port 122. The fixing block 331 and the fixing arms 332 are inserted in the groove 131 and the hooks 3321 buckle into the corresponding fixing holes 130. The fixing bar 334 is received in the gap 132 and the barb 3341 buckles into the fixing trough 133. The protrusion 335 is inserted in the fixing recess 134. Therefore, the dust-proof cover 30 is firmly mounted on the rear of the sidewall 12 of the connector body 10 to seal the second port 122 of the perforation 120. When the plug connector 4 is inserted in the receptacle connector 1, the latches 40 of the plug connector 4 are inserted into the corresponding perforations 120 of the connector body 10 of the receptacle connector 1 from the first port 121. The front of the latch 40 is received in the corresponding receiving space 32 of the dust-proof cover 30 and the fixing ribs 124 of the connector body 10 buckle into the respective fillisters 401 of the latch 40 to ensure that the terminals 20 of the receptacle connector 1 firmly electrically contact with the corresponding plug terminals 41 of the plug connector 4.

As described above, the fixing rib 124 of the connector body 10 is designed to buckle with the corresponding fillister 401 of the latch 40 for making the receptacle connector 1 and the plug connector 4 electrically connect with each other firmly. The locking portion 33 and the corresponding fixing section 13 buckle with each other to make the dust-proof cover 30 firmly mounted on the rear of the respective sidewall 12 of the connector body 10 so as to seal the second port 122 of the perforation 120 for preventing dust outside the perforation 120 from entering an electronic device along the perforation 120 to contaminate a printed circuit board of the electronic device (not shown).

What is claimed is:

1. A receptacle connector adapted to mate with a plug connector having at least one latch, the receptacle connector comprising:

a connector body defining at least one perforation therethrough, the perforation having a first port from which the latch of the plug connector is received in the perforation, and a second port communicating with the first port;

a plurality of terminals received in the connector body; and at least one dust-proof cover mounted on a rear portion of the connector body to seal the second port of the perforation to prevent dust outside the perforation from entering along the perforation;

wherein the rear portion of the connector body defines a fixing section and the dust-proof cover defines a locking portion for buckling with the fixing section to fix the dust-proof cover on the connector body, the fixing section including a groove defined in the rear portion of the connector body and adjacent to one side of the perforation, the groove extending upward and downward to form a pair of fixing holes;

wherein the dust-proof cover has a base body, the locking portion includes a fixing block protruding forward from the base body, a top and a bottom of the fixing block respectively extend forward to form a pair of fixing arms, one side of each of the fixing arms protrudes oppositely towards the fixing hole to form a pair of hooks, the fixing block and the fixing arms are inserted in the groove and the hooks buckle into the respective fixing holes.

2. The receptacle connector as claimed in claim 1, wherein a middle of a front of the base body hollows rearward to form a receiving space communicating with the second port of the perforation of the connector body for receiving a front of the latch of the plug connector.

3. The receptacle connector as claimed in claim 1, wherein the fixing section further includes a gap defined in an upper portion of the rear portion of the connector body and adjacent to the other side of the perforation, a front of the gap extends downward to form a fixing trough, the locking portion further includes a fixing bar extending forward from an upper portion of the base body, a front of the fixing bar protrudes downward to form a barb, the fixing bar is received in the gap and the barb buckles into the fixing trough.

4. The receptacle connector as claimed in claim 3, wherein the fixing section further includes a fixing recess defined in a lower portion of the rear portion of the connector body and located at the same side of the perforation with the gap, the locking portion further includes a protrusion protruding forward from a lower portion of the base body and inserted in the fixing recess.

* * * * *